United States Patent [19]

Stafford et al.

[11] 4,323,115

[45] Apr. 6, 1982

[54] SHELL AND TUBE HEAT EXCHANGER WITH POLYMERIC TUBE SHEETS

[75] Inventors: Donald C. Stafford, Hinsdale; Vincent F. Allo, Warrenville, both of Ill.

[73] Assignee: Chicago Bridge & Iron Company, Oak Brook, Ill.

[21] Appl. No.: 191,357

[22] Filed: Sep. 26, 1980

[51] Int. Cl.[3] ..... F28F 9/16

[52] U.S. Cl. ..... 165/79; 165/158; 165/175; 165/DIG. 8

[58] Field of Search ..... 165/79, 173, 175, 178, 165/DIG. 8, 158

[56] References Cited

U.S. PATENT DOCUMENTS

| | | | |
|---|---|---|---|
| 3,633,660 | 1/1972 | Young | 165/173 X |
| 3,804,161 | 4/1974 | Nowak | 165/158 |
| 3,993,126 | 11/1976 | Taylor | 165/79 X |
| 4,117,884 | 10/1978 | Frei | 165/79 X |
| 4,190,101 | 2/1980 | Hartmann | 165/DIG. 8 |
| 4,224,982 | 9/1980 | Frei | 165/DIG. 8 |

FOREIGN PATENT DOCUMENTS

| | | | |
|---|---|---|---|
| 2036398 | 2/1971 | Fed. Rep. of Germany | 165/173 |
| 2734958 | 2/1979 | Fed. Rep. of Germany | 165/79 |
| 431520 | 7/1935 | United Kingdom | 165/DIG. 8 |
| 558124 | 12/1943 | United Kingdom | 165/DIG. 8 |
| 731431 | 6/1955 | United Kingdom | 165/79 |

*Primary Examiner*—Sheldon J. Richter

*Attorney, Agent, or Firm*—Merriam, Marshall & Bicknell

[57] ABSTRACT

A heat exchanger having a plurality of spaced apart tubes, a shell around the tubes; a pair of spaced apart molded in place tube sheets of solid polymeric material bonded to the tubes and to the shell interior surface and providing the primary support for the tubes, a conduit to deliver a heat exchange fluid around the tubes inside of the shell between the tube sheets; and a conduit to deliver a liquid feed stream into a feed box partially defined by one of the tube sheets.

2 Claims, 5 Drawing Figures

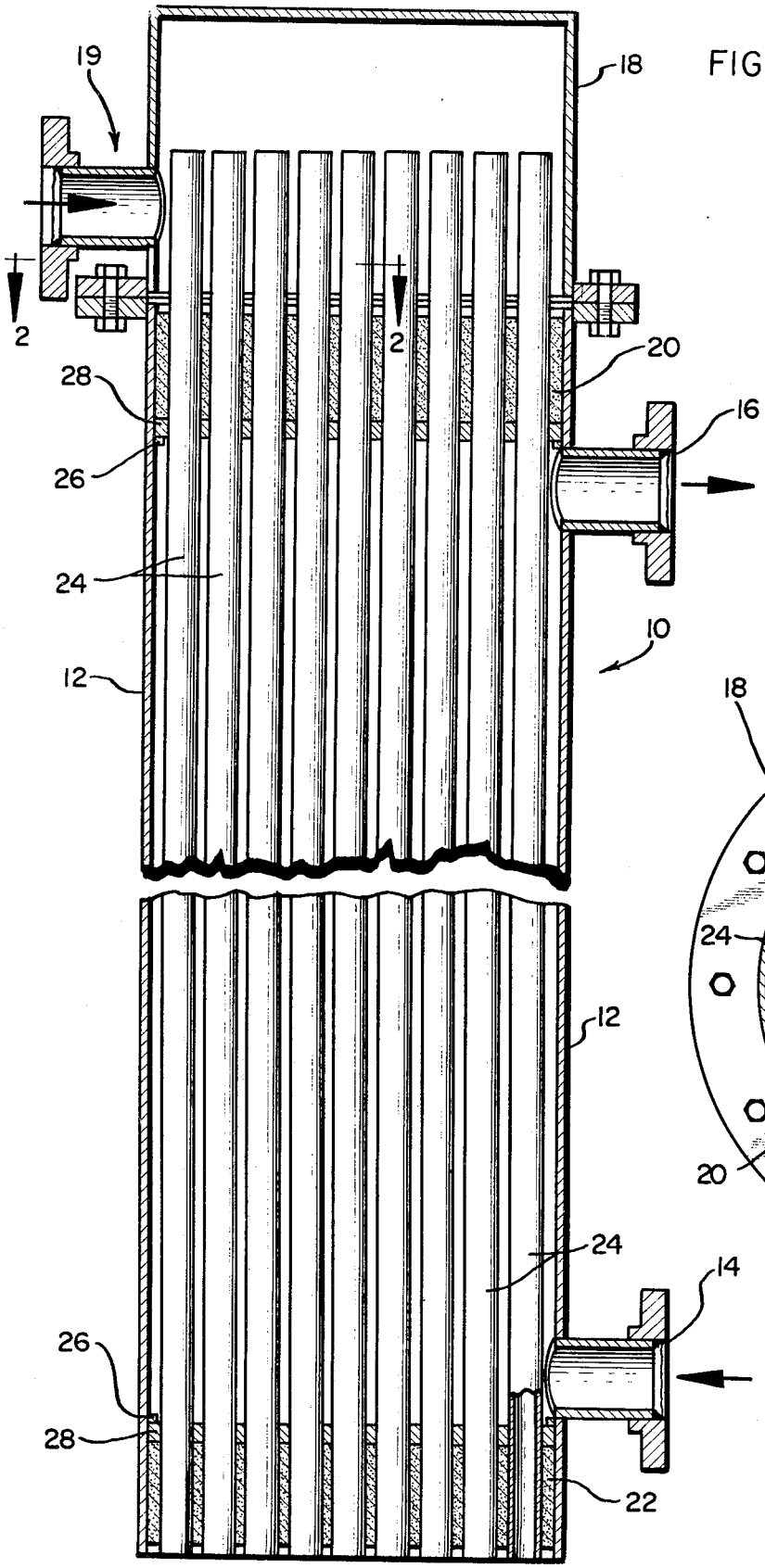
FIG. 1
FIG. 2
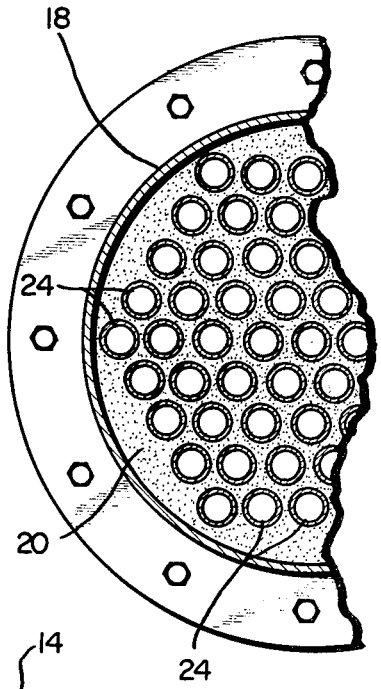

SHELL AND TUBE HEAT EXCHANGER WITH POLYMERIC TUBE SHEETS

This invention relates to heat exchangers. More particularly, this invention is concerned with improvements in shell and tube heat exchangers which permit non-destructive removal and replacement of each tube in the heat exchanger.

BACKGROUND OF THE INVENTION

Heat exchangers are widely used in many processing operations. One type of heat exchanger in wide use in generally referred to as a shell and tube heat exchanger. Such a heat exchanger has at least one tube extending between and through two spaced apart tube sheets surrounded by a shell. The shell is provided with an inlet and an outlet so that a suitable heat exchange fluid can be circulated through the shell to cool or heat a fluid flowing through each tube. Each end of the shell can be left upon for use in some processing operations and for others one or both ends of the shell can be closed, such as by a removable cover. Closing of one end of the shell to provide an enclosed feed box space is quite common. In addition, when the heat exchanger is to be used at high temperatures, the other shell end is usually also closed to provide a fluid collecting box to which fluid exits after flowing through each tube. Of course, the feed box is provided with a suitable feed inlet and the collecting box is provided with an outlet.

Although shell and tube heat exchangers are generally used to heat a liquid stream, they are also useful for cooling such a stream. When used for cooling purposes, each tube outlet end can be closed, or it can also be left open or uncovered so that the effluent can exit unrestrictedly into a suitable receptacle. Similarly, the tube inlet end can be enclosed or it can be left open and the liquid to be cooled fed to the tube by any suitable means. Thus, a wier can be provided around the tube sheet so that a pool of liquid is formed and flows into the open mouth of each tube.

Shell and tube heat exchangers of the described types can be used for producing fresh water from brackish water and sea water, for concentrating fruit and vegetable juices, and in industrial crystallization processes. As the liquid flows through each tube it can be cooled enough to crystallize out a solid from the liquid. Thus, by cooling sea water, ice is obtained which when separated, washed and melted provides potable water. When a fruit or vegetable juice is similarly chilled, ice forms and is removed thereby providing a concentrated juice.

The copending U.S. patent applications of Engdahl et al Ser. No. 160,112 and Engdahl Ser. No. 160,002, both filed June 16, 1980 disclose heat exchangers (also called freeze exchangers) for cooling liquids. The disclosure of those patent applications is incorporated herein by reference.

The tubes of freeze exchangers, which are a species of heat exchanger, must have a surface which discourages ice from sticking to the tube. Stainless steel tubes with highly polished surfaces are suitably used in freeze exchangers. However, if the polished surface deteriorates to such an extent that ice sticks there could be a loss of efficiency and ultimately plugging of the tube.

Shell and tube heat exchangers (including freeze exchangers) are manufactured with the tubes permanently joined to the tube sheets be welding or by a tube expansion method. Permanent installation of the tubes makes it very difficult and expensive to repair a heat exchanger if a tube leaks, corrodes or becomes plugged. Generally, removal of a tube involves destruction of the tube, and sometimes destruction of adjacent tubes to provide access. In addition, damage to the tube sheets often results. A need accordingly exists for an improved heat exchanger having each tube installed in a manner which permits its ready non-destructive removal.

SUMMARY OF THE INVENTION

The present invention provides a heat exchanger having a plurality of spaced apart tubes; a shell around the tubes, a pair of spaced apart molded in place tube sheets of solid polymeric material bonded to the tubes and to the shell interior surface and providing the primary support for the tubes; means to deliver a heat exchange fluid around the tubes inside of the shell between the tube sheets; and means to deliver a liquid feed stream into a feed box partially defined by one of the tube sheets.

The shell interior surface, and the exterior surfaces of the tubes, in contact with the polymeric tube sheets can be roughened to provide enhanced bonding.

A layer of insulation can be placed adjacent the inside of each polymeric tube sheet to retard heat leak to the tube sheets from a heat exchange fluid circulating through the shell side of the heat exchanger.

The polymeric material used for the tube sheets desirably liquefies or degrades upon heating to an elevated temperature, which does not damage the shell or tubes, so that one or more of the tubes can be removed for repair or replacement.

Although thermoplastic and thermosetting resins can be used for the tube sheet, it is desirable to use a solid polymeric material formed from a room temperature catalyzed liquid resin, and particularly an epoxy resin.

A heat exchanger provided by the invention eliminates expensive fabrication of metal tube sheets, permits ready removal of the tubes and fast, low cost reassembly of the heat exchanger. The monolithic molded in place polymeric tube sheets extend over the full shell internal diameter and need not incorporate ancillary structural elements which may occupy much of the area and space between the tubes and shell.

BRIEF DESCRIPTION OF THE DRAWINGS

FIG. 1 is a sectional view through a vertical shell and tube heat exchanger having molded in place tube sheets of polymeric material;

FIG. 2 is a partial sectional view taken along the line 2—2 of FIG. 1;

DETAILED DESCRIPTION OF THE DRAWINGS

To the extent it is convenient and practical, the same elements or parts which appear in the various views of the drawings will be identified by the same numbers.

Figure 3:
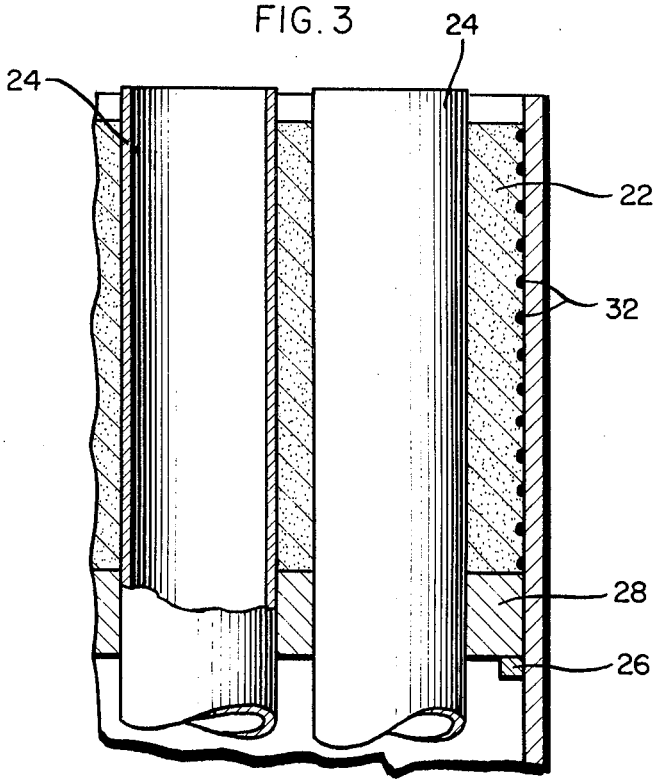
FIG. 3 is an enlarged partial view of the top tube sheet shown in the heat exchanger of FIG. 1.

With reference to FIGS. 1 to 3, the heat exchanger 10 includes a vertical, circular cylindrical shell 12 having a heat transfer or exchange fluid inlet 14 and outlet 16.

The top of shell 12 is enclosed by a removable cover 18 which is bolted to shell 12. Cover 18 has a liquid feed inlet 19.

A plurality of heat exchange circular parallel tubes 24 are positioned in shell 12 parallel to the shell axis. An upper tube sheet 20, and lower tube sheet 22, each essentially identical with the other and made of a solid polymeric material molded in place, secure the tubes 24 in position in the shell 12.

To mold the tube sheets in place, a bar stop 26 is first secured inside of shell 12 to support a sheet of insulating material 28 through which the tubes 24 project. The insulating material 28 is positioned so as to be in contact with the heat exchange fluid which is to be circulated through the shell side of the heat exchanger to thereby retard heat loss to the tube sheets. A glass fiber reinforced polymethacrylate may be used for the insulating material 28, provided it, or whatever insulating material is used, is compatible with the heat exchange fluid.

Once the sheet of insulating material 28 is put in position, the polymeric material to be used for the adjoining tube sheet is cast in place in liquid form and then permitted to solidify. Thermoplastic, as well as thermosetting, polymeric materials can be used to mold the tube sheets in place. It is preferred, however, to use a liquid resin which is catalyzed at room or ambient temperature into a tough, strong solid polymeric material. Epoxy resins are particularly useful since they are available as liquids, solidify quickly and have the necessary physical and chemical properties. A commercially available epoxy resin which can be used is marketed as Chockfast Orange 610-TCF by Philadelphia Resins Company.

In casting the tube sheets in place it should be understood that the upper tube sheet 20 is cast or molded in place with the heat exchanger top in uppermost position but that to mold the lower tube sheet 22 in place the heat exchanger is inverted. Of course, the cover 18 is not installed until after the tube sheet 20 is molded in place.

Joining of the tube sheets 22 and 24 to the shell can be substantially increased in mechanical strength by depositing weld heads (FIG. 3) on the inside surface of the shell 12 where the tube sheets contact it. Similarly, bonding of the polymeric material to the tubes 24 can be increased by roughening the tube surfaces before the liquid resin is poured in place. The tubes can be roughened by means of grooves cut in the surface, grinding or by use of emery cloth.

The polymeric material used for the tube sheets can be reinforced, if desirable, by including in it metal or glass fibers, expanded metal particles, glass beads or sand.

Figure 4:
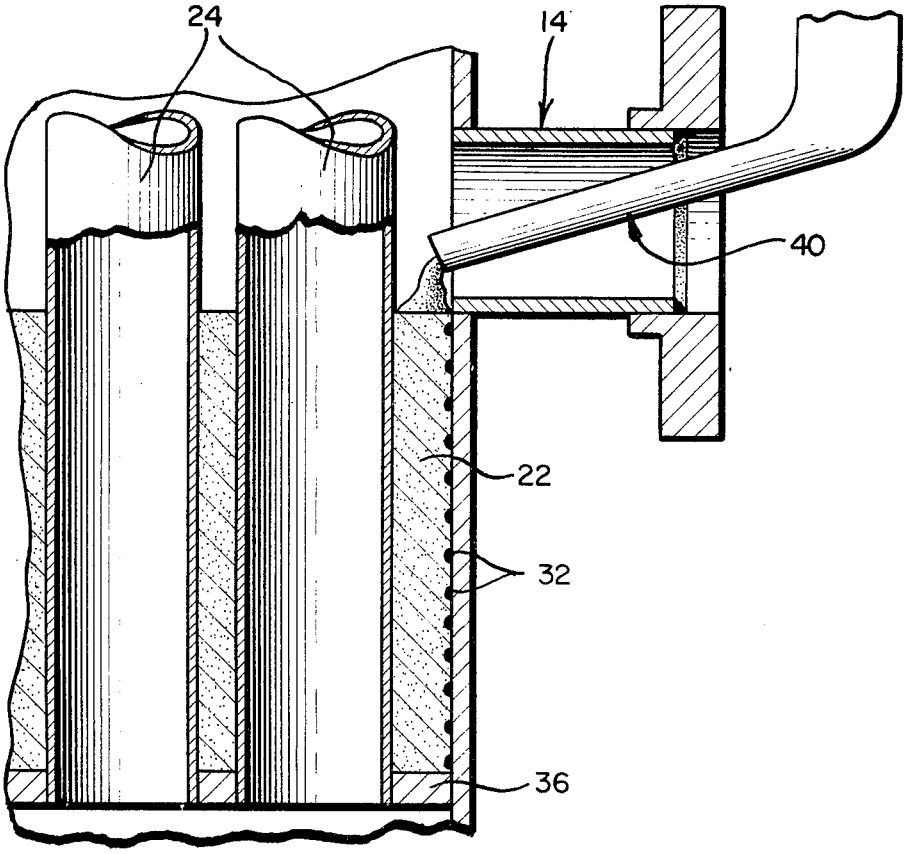
FIG. 4 is a partial vertical sectional view illustrating one method of molding the polymeric tube sheets in place.

It may be desirable at times to exclude the use of a sheet of insulating material 28 adjacent the tube sheet. However, when that is done a temporary dam 36 (FIG. 4) of wood or a solid plastic material can be used to maintain the liquid polymeric material to be used for the tube sheet in place until it solidifies. The temporary dam is positioned so as to be on the outside of the tube sheet so that it is subsequently easily accessible for removal. Pouring the liquid polymeric material in place is readily effected by use of a delivery nozzle 40 inserted into the heat exchange fluid inlet 14 and outlet 16.

The tubes 24 can be removed without damage from the heat exchangers by applying enought heat to the polymeric tube sheets to cause the polymeric material to melt or to degrade. The tubes can then be repaired or refinished as appropriate, or they can be replaced.

The heat exchangers illustrated in the drawings are particularly useful as freeze exchangers for freezing out ice from saline water or brackish water, or for concentrating fruit and vegetable juices. The heat exchange fluid can be liquefied ammonia or some other gaseous refrigerant.

Although the drawings illustrate a vertical heat exchanger, it should be understood that the heat exchanger can also be positioned horizontal for some purposes.

When there is a substantial pressure on the shell side of the heat exchanger, or a significant differential pressure between the pressure in the tubes and the shell side pressure, it may be desirable to employ composite tube sheets having two or more layers or polymeric material characterized by high compressive or tensile strength. For example, if the shell side operates at a high pressure the inner one-half of each tube sheet can be made of a polymeric material having high compressive strength, such as a sand filled epoxy material. The outer one-half of the tube sheet can be made of a polymeric material having high tensile strength, such as a metal or glass fiber filled epoxy resin so that it can more easily resist the tube sheet dishing caused by the shell side pressure. If the tube pressure, however, is much higher than the shell pressure it may be desirable to reverse the described order of the layers so that the high tensile strength layer is on the shell side.

Figure 5:
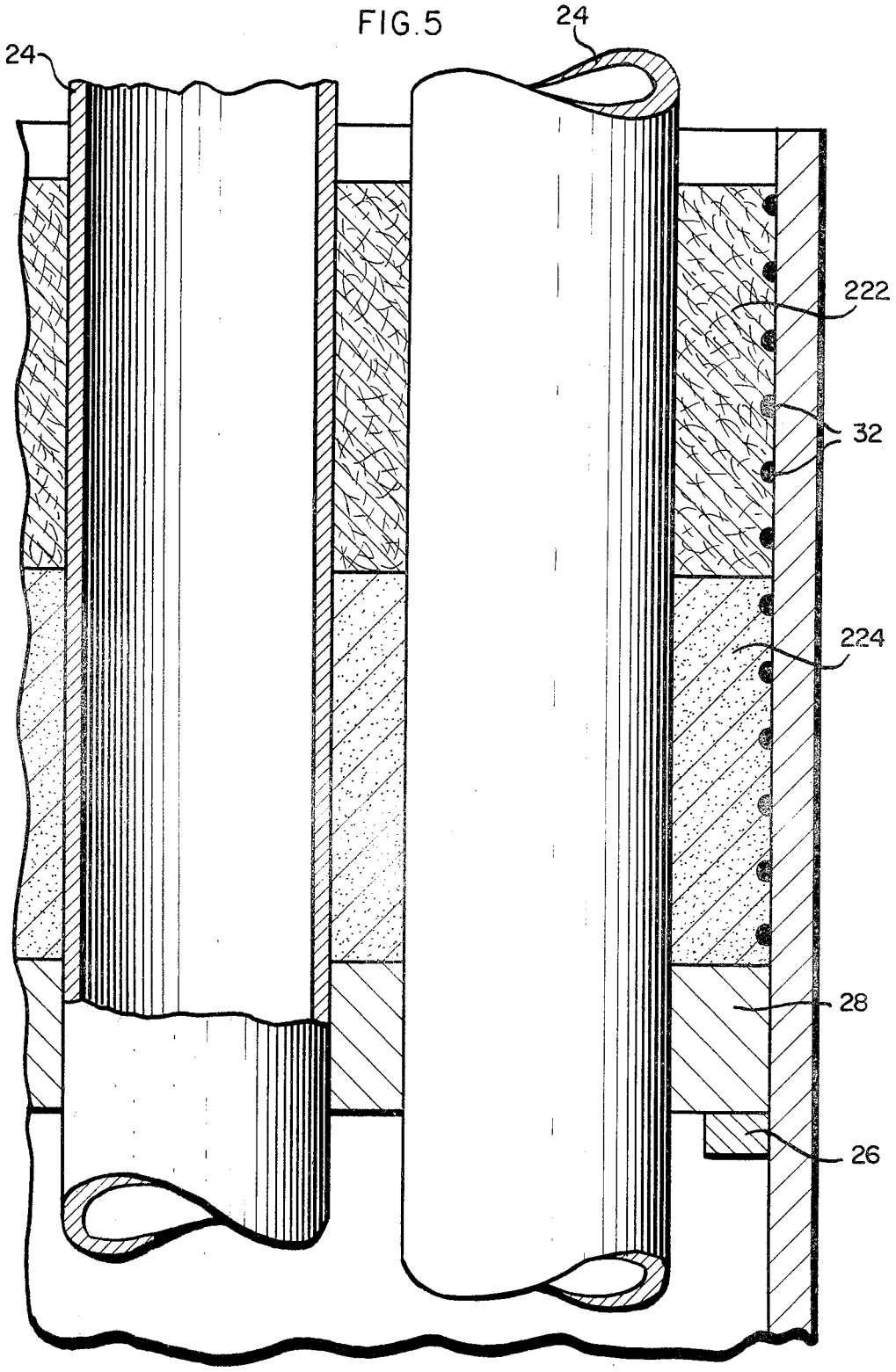
FIG. 5 is similar to FIG. 3 but shows a two layer tube sheet.

FIG. 5 illustrates a tube sheet of the described two layer type. The outer layer 222 comprises a polymeric material containing fibers which have high tensile strength, such as fibers of metal or glass, and the inner layer comprises a polymeric material containing a particulate material which has high compressive strength, such as sand.

The foregoing detailed description has been given for clearness of understanding only, and no unnecessary limitations should be understood therefrom as modifications will be obvious to those skilled in the art.

What is claimed is:

1. A heat exchanger comprising:

a plurality of spaced apart tubes;

a shell around the tubes;

a pair of spaced apart molded in place tube sheets of solid polymeric material bonded to the tubes and to the shell interior surface and providing the primary support for the tubes;

at least one tube sheet having a high tensile strength layer of polymeric material and a high compressive strength layer of polymeric material;

means to deliver a heat exchange fluid around the tubes inside of the shell between the tube sheets; and means to deliver a liquid feed stream into a feed box partially defined by one of the tube sheets.

2. A heat exchanger according to claim 1 in which both tube sheets comprise a high tensile strength layer of polymeric material and a high compressive strength layer of polymeric material.

* * * * *

UNITED STATES PATENT AND TRADEMARK OFFICE

CERTIFICATE OF CORRECTION

PATENT NO. : 4,323,115

DATED : April 6, 1982

INVENTOR(S) : DONALD CLAUDE STAFFORD ET AL

It is certified that error appears in the above-identified patent and that said Letters Patent are hereby corrected as shown below:

Column 1, line 13, change "use in" to --use is--; line 21, change "upon" to --open--; line 55, after "1980" insert --, now U.S. patents 4,286,436 granted Sept. 1, 1981 and 4,314,455 granted Feb. 9, 1982 respectively,--; Column 3, line 43, change "heads" to --beads--; Column 4, line 2, change "enought" to --enough--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*